United States Patent [19]

Davis

[11] Patent Number: 4,568,401

[45] Date of Patent: Feb. 4, 1986

[54] METHOD OF MAKING A FREE FLOATING SHEATHED CABLE

[76] Inventor: Ervin M. Davis, 2019 Compass La., Anaheim, Calif. 92801

[21] Appl. No.: 716,512

[22] Filed: Mar. 25, 1985

Related U.S. Application Data

[63] Continuation of Ser. No. 516,131, Jul. 21, 1983, abandoned, which is a continuation-in-part of Ser. No. 475,102, Mar. 14, 1983, which is a continuation-in-part of Ser. No. 228,687, Jan. 26, 1981, abandoned.

[51] Int. Cl.[4] ..... H01B 13/08

[52] U.S. Cl. ..... 156/55; 29/857; 156/56; 174/110 F; 174/110 FC; 339/28

[58] Field of Search ..... 29/857, 859; 156/52, 156/53, 55, 56; 174/110 F, 110 FC; 339/28, 29 R

[56] References Cited

U.S. PATENT DOCUMENTS

| | | | |
|---|---|---|---|
| 3,516,859 | 6/1970 | Gerland et al. | 174/110 F X |
| 3,766,309 | 10/1973 | Calzolari et al. | 174/110 F X |
| 4,000,348 | 12/1976 | Harlow | 428/422 |
| 4,003,620 | 1/1977 | O'Brien et al. | 339/29 R |
| 4,269,638 | 5/1981 | Faranetta et al. | 156/53 |
| 4,368,350 | 1/1983 | Perelman | 174/110 F X |
| 4,411,633 | 10/1983 | Waldron | 29/857 X |
| 4,423,282 | 12/1983 | Suzuki et al. | 174/36 |
| 4,443,657 | 4/1984 | Hill et al. | 174/110 FC |

FOREIGN PATENT DOCUMENTS

| | | |
|---|---|---|
| 1777885 | 9/1958 | Fed. Rep. of Germany . |
| 1094322 | 5/1961 | Fed. Rep. of Germany . |
| 53-29829 | 8/1978 | Japan . |
| 55-41622 | 3/1980 | Japan . |
| 57-21809 | 5/1982 | Japan . |
| 57-22643 | 5/1982 | Japan . |
| 57-17921 | 11/1982 | Japan . |
| 57-20341 | 12/1982 | Japan . |

OTHER PUBLICATIONS

"Koaxialkabel-Lagertypenkatalog, Amphenol, DW 61" (German Industrial Catalog-no date).

*Primary Examiner*—Robert A. Dawson

*Attorney, Agent, or Firm*—Spensley Horn Jubas & Lubitz

[57] ABSTRACT

A method of making an electrical cable in which an inner electrical conductor is loosely carried within the interior of an outer sheath. The inner conductor has a length in excess of the length of the sheath such that the cable is better able to withstand stretching and bending without damage to the inner electrical conductor.

6 Claims, 7 Drawing Figures

METHOD OF MAKING A FREE FLOATING SHEATHED CABLE

CROSS-REFERENCE TO RELATED APPLICATIONS

This application is a continuation of application Ser. No. 516,131, filed July 21, 1983, now abandoned , which in turn is a continuation-in-part application of application Ser. No. 475,102, filed Mar. 14, 1983, which in turn is a continuation-in-part application of application Ser. No. 228,687, filed Jan. 26, 1981, and now abandoned.

BACKGROUND OF THE INVENTION

1. Field of the Invention

The present invention relates to electrical cables, and more particularly, to electrical cables having one or more inner conductors which are housed in an outer sheath.

Electrical cables are used to interconnect various electrical devices and terminals which are physically distant from each other. The cable carries electrical signals over one or more wires or conductors running the length of the cable, each of which is covered with a layer of insulating material. A male or female type connector is usually attached to each end of the cable. Each connector has a plug body to which the conductors of the cable are electrically connected. The plug body mates to a terminal or "jack" of the device being connected. The connector also usually has an outer cylindrical shell which protects the interconnection of the cable conductors to the plug body.

One type of cable, often referred to as an "audio cable", is extensively used to connect amplifiers to remote speakers and microphones as well as electrical musical instruments, such as electric guitars. Other uses of electrical cables include interconnecting video tape recorders to television receivers.

In order to prevent outside radio frequency (rf) noise from interfering with the signal transmitted over the cable, many cables have coaxial conductors which form an inner coaxial cable These coaxial cables have an inner strand of conductive wires surrounded by an insulating layer and then an outer layer of conductive wires. These outer wires are typically braided together to form a shield around the inner wires to reduce the interference to the inner wire signals caused by spurious rf noise 2. Description of the Prior Art To protect the inner conductors, the electrical cable usually has a tough plastic or rubber sheath surrounding the conductors over the length of the cable. This outer sheath has typically been extruded directly onto the insulation covering the inner conductors, such that the conductors are tightly held within the sheath. However, even with this outer protective sheath, the inner conductors of the cable are often broken as a result of the stretching and bending normally encountered in normal use of the cable. This is particularly true for cables in which the conductors are made of strands or braids of fine copper wires as in many coaxial cables.

Since silver has a lower resistivity than copper, it would be desirable to plate the copper wires of a coaxial cable with silver in order to minimize the cable's electrical resistance and maximize the rejection rf of noise. However, because silver is relatively expensive, it is often not practical to use silver plated conductors where it is likely that the cable will not last.

Another problem experienced with coaxial cables is the tendency of the cable to "microphone" when bent. If the coaxial cable is sharply bent, the spacing between the inner strands and the outer shield can be significantly affected, thereby changing the capacitance of the coaxial cable. This can disrupt the signal transmission properties of the cable, which can be a siqnificant problem when transmitting audio signals over the cable.

In addition, many cables have a clamp at each end to clamp the end of the cable connector plug body. This clamp often cuts or wears through the outer sheath exposing the inner insulation and conductors, and causing the conductors to break.

SUMMARY OF THE INVENTION

It is an object of the present invention to provide an improved electrical cable which minimizes the breakage of the interior electrical conductors as a result of mechanical stress applied to the cable.

It is still another object of the present invention to provide an electrical cable having increased reliability and which is less susceptible to microphoning.

The present invention is directed to an electrical cable wherein the inner electrical conductors are loosely carried within the interior of an outer sheath. In addition, the inner conductors are longer than the sheath. It has been found such an arrangement improves the ability of the cable to withstand mechanical stress applied to the cable without the electrical conductor breaking.

In another aspect of the present invention, each end of the sheath is coupled to the shell of the electrical connector instead of the plug body. Since the inner conductors are not affixed to the outer sheath, stretching or bending the outer sheath does not directly shear the the connection between the inner conductors and the plug body, further increasing the reliability of the cable. Furthermore, as will become more clear in the following description, the need for any clamps to couple the cable to the connectors is eliminated.

DETAILED DESCRIPTION OF THE DRAWINGS

Figures 1, 2, 3, 4, 5, 6, 7:
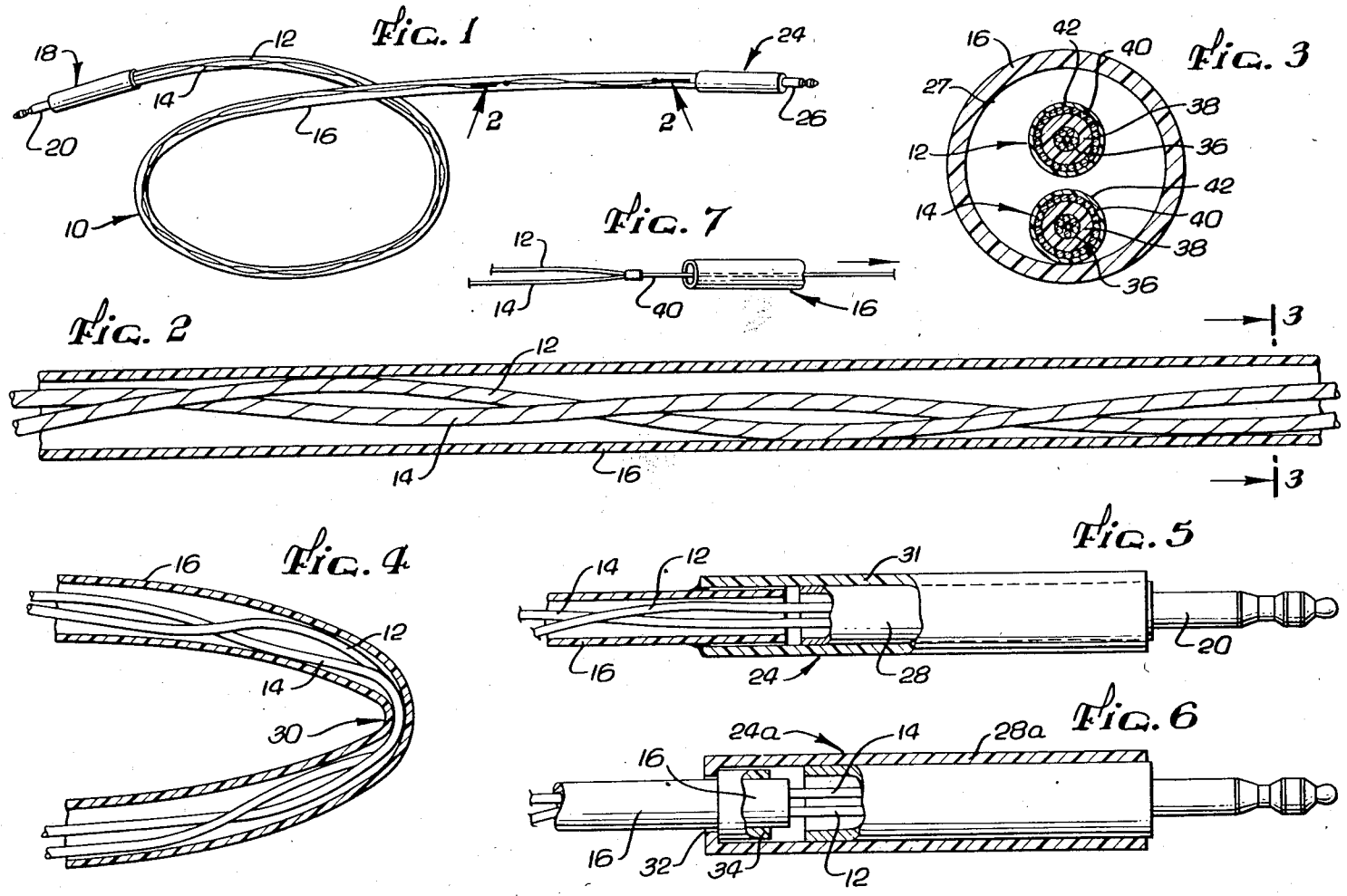
FIG. 1 is a perspective view of an electrical cable in accordance with the present invention.
FIG. 2 is a longitudinal sectional view of the cable of FIG. 1 along the line 2—2.
FIG. 3 is a cross sectional view of the cable of FIG. 2 along the line 3—3.
FIG. 4 is a schematic diagram illustrating the affect of crimping on the cable of FIG. 1.
FIG. 5 is an enlarged partially broken away view of a connector for the cable of FIG. 1.
FIG. 6 is an alternative embodiment of the connector of FIG. 5.
FIG. 7 is a schematic diagram illustrating a step in a method of construction of a cable in accordance with the present invention.

Referring now to FIG. 1, an electrical cable in accordance with the present invention is indicated generally at 10. The cable 10 of the illustrated embodiment is an audio cable which includes an inner pair of coaxial cables 12 and 14 which are protected by a tough, flexible outer sheath 16. In the illustrated embodiment, the outer sheath 16 is made of clear FDA beverage grade vinyl but may be made of any suitably tough, flexible and preferably non-conducting material. Affixed to one end of the audio cable 10 is a connector 18 which includes a plug body 20. The inner coaxial cables 12 and 14 are electrically connected to terminals (not shown) of the plug body 20 by any suitable means, such as soldering.

Surrounding the plug body terminals is a cylindrically shaped shell 28 (FIG. 5). The shell 28 protects the interconnections of the inner cables 12 and 14 with the plug body 20 from becoming loose or broken due to accidental impact of objects with the connector 18. The audio cable 10 has a second connector 24 affixed to the other end of the cable 10. The inner coaxial cables 12 and 14 are electrically connected to the plug body 26 of the connector 24 in a similar manner.

As best seen in FIGS. 2 and 3, the outer sheath 16 is a hollow tubular structure which has an inner diameter which is significantly larger (2 to 3 times larger) than the outer diameter of either of the inner coaxial cables 12 or 14. Furthermore, the coaxial cables 12 and 14 are loosely carried within the interior 27 of the sheath 16. That is, neither of the cables 12 or 14 is affixed to the inner surface of the outer sheath 16.

In addition, the length of both of the inner coaxial cables 12 and 14 within the sheath 16 is longer than of the length of the outer sheath 16. As best seen in FIG. 1, the twisted pair of coaxial cables 12 and 14 describe a free floating gentle spiral within the outer sheath 16. As a result, should the audio cable 10 be inadvertently stretched, the inner coaxial cables 12 and 14 initially will not be stretched with the sheath 16, but will merely straighten out. In the illustrated embodiment, the sheath 16 can be stretched up to five percent (5%) of its total length before the inner cables 12 and 14 have completely straightened. This provides significant protection for the inner coaxial cables 12 and 14 against accidental breakage due to stretching of the audio cable 10.

As previously mentioned, repeatedly bending an audio cable back and forth can also damage the inner conductors within. The more sharply that a cable is bent, the more likely it is that the individual wires of conductors will break. However, breakage due to bending is also significantly reduced in an audio cable of the present invention.

Referring now to FIG. 4, a portion of the audio cable 10 is shown bent at a sharp angle. The sharpness of the angle is particularly accentuated on the inside portion of the bend as indicated at 30. In prior art audio cables where the outer sheath is tightly extruded onto the inner cables, the inner cables are forced to bend with the sharp bend of the outer sheath, thereby often resulting in breakage of the inner conductors. However, as shown in FIG. 4, since the inner coaxial cables 12 and 14 are loosely carried within the sheath 16, the bend of the coaxial cables 12 and 14 is significantly minimized, thereby reducing the risk of breaking the conductors and increasing the life of the audio cable.

In that an audio cable in accordance with the present invention can be expected to have a significantly longer life than many prior art audio cables, the use of relatively expensive conductors such as silver-plated copper wires in the inner coaxial cables is made more practical as a result. As previously mentioned, silver-plated copper conductors are desired for use in coaxial cables because of their low resistivity and high rejection of rf noise capability, but have often been avoided as too expensive to use in cables that quickly wear out.

An audio cable in accordance with the present invention can also help reduce "microphoning" which can occur when coaxial cables are overstressed. Sharply bending a coaxial cable can affect the capacitance of the coaxial cable thereby altering its transmission characteristics. Because the present invention reduces the stress applied to the inner coaxial cable when the audio cable is crimped (as shown in FIG. 4), any resultant microphoning effect is also reduced or eliminated.

Referring now to FIG. 5, the outer sheath is shown coupled to the shell 28 of the connector 24 by a cylindrical vinyl outer sleeve 31. The sleeve 31 is slipped over the connector shall 28 and the outer sheath 16. The sleeve 31 is affixed to the shell 28 and the outer sleeve 16 by gluing or other suitable means.

As previously mentioned, in many prior art cables the outer sheath is clamped directly to the plug body of the connector. This clamping can pierce the outer sheath or cause it to rupture after repeated flexing of the sheath at the clamp. As a result, the inner coaxial cables at the point of rupture are no longer protected by the sheath such that the conductors within the coaxial cables are often soon broken. As seen in FIG. 5, the use of the sleeve 31 eliminates the need for clamps. Furthermore, attaching the sheath 16 to the shell 28 instead of the plug body 20 maintains the separation of the sheath 16 from the inner coaxial cables.

Thus, in the illustrated embodiment, the inner coaxial cables 12 and 14 are not connected to the outer sheath 16 over their entire length. As a result, any twisting or pulling applied to the outer sheath 16 is not transmitted directly to the inner cables 12 and 14. In addition, the outer shield wires of each coaxial cable can be fully soldered to the plug body without melting the outer sheath 16. In many prior art cables, the coaxial shield wires were often clamped or spot soldered to the plug body terminals to prevent overheating the outer sheath which was tightly extruded around the coaxial cable.

FIG. 6 shows an alternative method of coupling the sheath 16 to a somewhat different connector **24*a*. In this embodiment, the diameter of the shell 28*a* of the connector 24*a* is sufficiently larger than the sheath 16 to enable the sheath 16 to be inserted through an opening 32 in the shell 28*a*. To affix the sheath 16 to the connector shell 28*a*, a vinyl sleeve 34 is inserted over the end of the sheath 16 within the shell 28*a*. In the illustrated embodiment, the sleeve 34 is glued to the end of the sheath 16 and to the inner surface of the cylindrical connector she11 28*a***.

Here also, the need for clamps is eliminated, and the sheath 16 is affixed to the connector shell **28*a* and not to the plug body 24*a*. As a result, the sheath 16 and the inner coaxial cables 12 and 14 are maintained separate. It is recognized that other means may be devised for coupling the outer sheath 16** to the shell of the connector depending upon the particular size and design of the connector and connector shell.

Referring back to FIG. 3, a cross-sectional view of the coaxial cables 12 and 14 shows that each inner coaxial cable includes an inner conductor 36 which comprises a plurality of silver-plated copper wire strands. The inner conductor 36 is separated by an insulating layer 38 from an outer shield 40 which comprises a plurality of braided silver-plated copper wire strands. The shield 40 is covered by a second insulating layer 42. In the illustrated embodiment, the insulating layer 38 is made of polytetrafluoroethylene, T.F.E. grade (available under the registered trademark Teflon), foam tape which has a desirable dielectric property for the insulating layer 38. The outer layer 42 is made of solid Teflon tape, T.F.E. grade which has a low friction surface for the insulating layer 42. The low friction surface of the layer 42 helps prevent the coaxial cables 12 and 14 from binding with the inner surface of the sheath 16.

The cables 12 and 14 are minature coaxial cables in which the inner conductor 36 is on the order of 26 gauge in size, and the outer diameter of the shield layer 40 is approximately 18 gauge. It has often been impractical in the past to utilize such miniature coaxial cables except in a closed environment such as the interior of a cabinet where the cable is not likely to be disturbed. It has been found that miniature cables are usually too fragile to withstand the stretching and bending which can occur to external cables. However, since the miniature coaxial cables 12 and 14 are loosely carried within the sheath 16 in accordance with the present invention, the audio cable 10 is able to withstand much of the usual stretching and bending that occurs to such cables so that it is practical to utilize the miniature coaxial cables in an external environment.

The inner conductor 36 of the illustrated embodiment is wound from 7 or 19 strands of 38 gauge silver-plated copper to form a round inner cable. In a continuous process with the winding of the inner conductor 36, the insulating layer 38 is formed around the inner conductor inner conductor is formed, by winding narrow Teflon foam tape around the inner conductor 36, followed sintering the spiral wound tape at 1200° F. to provide a continuous single piece Teflon foam jacket around the inner conductor. Immediately after sintering, the Teflon foam outer layer 38 is quenched in water. Use of Teflon foam tape enables the insulating layer formation to be a continuous process so that the length of the cable capable of being formed is not as limited as in some extrusion processes. It is recognized that for very low capacitance application such as video cables, a second layer of Teflon foam tape may be wrapped and sintered around the first sintered layer to further reduce interlayer capacitance between the inner conductor 36 and the outer shield 40.

The cable is then spooled and 38 gauge silverplated copper strands are braided in a cross-hatch pattern around the insulating layer 38 as the cable is pulled off the spool to form the outer shield 40. The shield 40 is continuously spiral wrapped as it is formed with solid Teflon tape which is also sintered and quenched to form a single piece outer insulating layer 42.

Referring now to FIG. 7, a method for assembling two inner cables 12 and 14 constructed as described above, with the outer sheath 16, will now be described. First, silicone is sprayed in the interior of the sheath 16 to facilitate the passage of the coaxial cables 12 and 14. Silicone may also be applied directly to the coaxial cables by any suitable manner such as applying liquid silicone with a cloth. Then, a relatively stiff leader wire 40 is attached to the cables 12 and 14 and is inserted through the sheath 16. The cables 12 and 14 are drawn behind the leader wire 40 until the cables emerge the desired distance out the other end of the sheath 16. Since the cables 12 and 14 are longer than the sheath 16, the excess length of the cables 12 and 14 is forced into the sheath 16. The leader wire 40 is removed and the connectors are coupled to the sheath 16 and the inner coaxial cables as shown in FIG. 1. A further advantage of the silicone lubricant is that it typically remains within the sheath 16 to help prevent the cables 12 and 14 from binding within the sheath 16 which further protects the cables 12 and 14.

It is apparent from the foregoing that the electrical cable of the present invention provides increased protection for the inner electrical conductors and therefore has an improved life expectancy. As a result, it is more practical to use relatively expensive conductors such as silver-plated copper to improve the electrical performance characteristics of the audio cable.

It will, of course, be understood that modifications of the present invention, in its various aspects, will be apparent to those skilled in the art, some being apparent only after study and other being merely matters of routine electrical and mechanical design. Other embodiments are also possible with the specific design depending upon the particular application. For example, it is recognized that electrical conductors other than coaxial cables may be utilized, as well as other types of connectors for the cable. As such, the scope of the invention should not be limited by the particular embodiments herein described, but should be defined only by by the appended claims and equivalents thereof. Various features of the invention are set forth in the following claims.

I claim:

1. A method for manufacturing an electrical cable comprising the steps of:

wrapping polytetrafluoroethylene foam tape around an inner conductor;

sintering the polytetrafluoroethylene tape to form a first single piece insulating layer around the inner conductor;

braiding strands of wire around the first insulating layer to form a shield;

wrapping solid polytetrafluoroethylene tape around the shield;

sintering the solid polytetrafluoroethylene tape to form a second insulating layer which is around the shield, wherein the inner conductor, shield and insulating layers form a coaxial cable;

attaching a leader wire to an the coaxial cable;

passing the leader wire through a sheath having an inner diameter in excess of the outer diameter of the coaxial cable and a length shorter than the length of the coaxial cable, so as to draw the coaxial cable into the sheath;

removing the leader wire;

electrically coupling each end of the inner conductor to a connector; and coupling each end of the sheath to a connector.

2. The method of claim 1 wherein the step of drawing the leader wire through the sheath is preceeded by the step of applying a lubricant to the interior surface of the sheath to facilitate the passage of the conductor through the sheath.

3. The method of claim 2 wherein the lubricant is silicone applied by spraying.

4. The method of providing a physically shielded audio cable which may be substantially bent or stressed without damage to the inner electrical conductors, comprising:

providing a coaxial cable formed by sequentially spiral wrapping and sintering polytetrafluoroethylene foam tape around an inner electrical conductor and wrapping and sintering solid polytetrafluoroethylene tape around an outer electrical conductor to form respective foam and solid polytetrafluoroethylene layers;

inserting a length of said coaxial cable through a sheath, the length of said coaxial cable being greater than the length of the sheath and the inner diameter of the sheath being substantially greater than the outer diameter of the solid teflon insulating layer of the coaxial cable; and providing electrical connectors at each end to form an assembly in which the length of the interior electrical conductor is greater than the sheath.

5. The method of claim 4 further comprising the step of applying a silicone lubricant to at least one of the interior of the sheath or the exterior of the solid polytetrafluoroethylene outer insulating layer to facilitate the passage of the coaxial cable through the sheath.

6. The method of claim 4 comprising the additional steps of wrapping a second layer of polytetrafluoroethylene foam tape around the first layer of wrapped and sintered polytetrafluroethylene foam tape, and sintering the second layer of polytetrafluoroethylene foam tape before the outer conductor is applied.

* * * * *